United States Patent [19]

Murayama et al.

[11] Patent Number: 4,977,000

[45] Date of Patent: Dec. 11, 1990

[54] PAINTING METHOD

[75] Inventors: Junichi Murayama; Kazuto Iiyama; Niichi Toyama; Katsushi Sadamitsu; Hideki Takashima, all of Sayama, Japan

[73] Assignee: Honda Giken Kogyo Kabushiki Kaisha, Tokyo, Japan

[21] Appl. No.: 298,129

[22] Filed: Jan. 17, 1989

[30] Foreign Application Priority Data

Sep. 22, 1988 [JP] Japan ..... 63-239152

[51] Int. Cl.[5] ..... B05D 1/02

[52] U.S. Cl. ..... 427/424; 118/DIG. 7; 118/323; 118/326; 427/421

[58] Field of Search ..... 427/421, 424; 118/DIG. 7, 323, 326

[56] References Cited

U.S. PATENT DOCUMENTS

| | | | |
|---|---|---|---|
| 2,900,950 | 8/1959 | Peeps | 118/2 |
| 3,533,422 | 10/1970 | Alimanestiano | 134/45 |
| 3,619,311 | 11/1971 | Rose et al. | 156/62 |
| 3,742,906 | 7/1973 | Dupke | 118/105 |
| 4,278,046 | 7/1981 | Clarke et al. | 118/695 |
| 4,590,654 | 5/1986 | Kajiura | 29/407 |

FOREIGN PATENT DOCUMENTS

| | | |
|---|---|---|
| 0084523 | 7/1983 | European Pat. Off. . |
| 60-25565 | 2/1985 | Japan . |
| 63-88081 | 4/1988 | Japan . |
| 806765 | 12/1958 | United Kingdom . |
| 1322861 | 7/1973 | United Kingdom . |
| 2087269 | 5/1982 | United Kingdom . |
| 2190312 | 11/1987 | United Kingdom . |
| 2200304 | 8/1988 | United Kingdom . |

*Primary Examiner*—Bernard Pianalto

[57] ABSTRACT

A substantially vertical surface of an object such as a vertical rear surface of an automotive body is coated in a coating booth in which a fluid such as air is supplied a downward direction to forcibly lower a mist of floating paint particles. Paint spray guns for ejecting paint sprays are positioned perpendicularly to the vertical surface. Then, the paint spray guns are displayed with respect to the vertical surface in a direction against the downward direction in which the fluid is supplied, while ejecting paint sprays from the paint spraying means to coat the vertical surface.

6 Claims, 4 Drawing Sheets

10
11
12
14
16
18
20
22
24
26
28a
28b
30
36
38
40
42a
42b
42c
42d
44a
44b
44c
44d
46a
46b
46c
46d
48
50
52
54
56
58a
58b
60
60a
62
64a
64b
66
68
70a(b)
70c(d)
72
74
76
76a
78
80
82
84
86
88
90
92
94
96a
96b
96c
98a
98b
98c
100
102
104
106
108
110
112
114
116
118
120a
120b
120c

PAINTING METHOD

BACKGROUND OF THE INVENTION

The present invention relates to a painting method, and more particularly to a method of coating a vertical surface of an object to be painted by ejecting paint sprays from paint spraying means while moving the paint spraying means upwardly from a position near a lower end of the vertical surface of the object to prevent ejected excessive paint from being applied to the paint spraying means.

Automobile industry in recent years employs highly automated line production processes for efficiently mass-producing automobile products. There are used assembling apparatus for assembling individual parts and conveyor apparatus for conveying components to respective working positions. Painting apparatus for painting or coating automobile bodies are also automatized. For example, Japanese Laid-Open Patent Publication No. 63-88081 discloses a technical concept for automatically coating an automotive body.

In the above conventional painting process, an automotive body and paint spraying means are displaced relatively to each other to keep the paint spraying means spaced a constant distance from front, upper, and rear surfaces of the automotive body while ejecting paint from the pain spraying means to coat the front, upper, and rear surfaces sequentially in the order named.

When applying a paint coat to the rear surface of the automotive body, the paint spraying means is lowered while ejecting the paint. Therefore, a paint mist floating in the coating room tends to be applied to the paint spraying means. More specifically, some of the paint ejected from the paint spraying means is not applied to the surface of the automotive body, but remains floating in the coating room. Usually, a downward air stream is forcibly passed through the coating room to cause the paint mist to fall so that no excessive paint coat will be applied to the paint spraying means.

While the paint spraying means and the automotive body are being relatively displaced at a predetermined speed, the speed of downward movement of the paint spraying means for coating the rear surface of the automotive body is higher than the speed at which the paint mist drops, because it is necessary to move the paint spraying means at a relatively high speed for efficiently coating the automotive body. When paint is ejected from the paint spraying means that is descending along the rear surface of the automotive body, excessive paint which falls as a slow mist below the paint spraying means tends to be attached to the paint spraying means. If the paint spraying means with such paint mist deposits carried thereon were continuously used, the paint mist deposits would drop onto the coated surface of the automotive body, thus deteriorating the coated layer on the automotive body. To avoid this, the paint spraying means has to be cleaned frequently. The cleaning process is tedious and time-consuming, and makes the entire coating procedure less efficient.

SUMMARY OF THE INVENTION

It is a primary object of the present invention to provide a method of coating a surface of an object, e.g., the rear surface of an automotive body by lowering paint spraying means down to a position near a lower end of the rear surface of the automotive body, and then elevating the paint spraying means along the automotive body rear surface while ejecting paint from the paint spraying means, thus preventing a mist of excessive paint which falls in a coating room from being applied to the paint spraying means, so that the paint spraying means can easily be maintained and the automotive body rear surface can efficiently be coated.

Another object of the present invention is to provide a method of painting a substantially vertical surface of an object in a coating booth in which a fluid is supplied a downward direction to forcibly lower a mist of floating paint particles, said method comprising the steps of: positioning paint spraying means for ejecting paint sprays, perpendicularly to said vertical surface; and displacing said paint spraying means with respect to said vertical surface in a direction against said downward direction in which said fluid is supplied, while ejecting paint sprays from said paint spraying means to coat said vertical surface.

Still another object of the present invention is to provide a method of painting the vertical surface of the object, wherein said paint spraying means comprises a plurality of paint spray guns, further including the step of: reciprocally moving said paint spray guns in a direction across said direction in which said paint spraying means is displaced, while displacing said paint spraying means with respect to said vertical surface.

Yet another object of the present invention is to provide a method of painting the vertical surface of the object, wherein said object is an automotive body.

A further object of the present invention is to provide a method of painting an upper surface and a trailing surface of a three-dimensional object with paint spraying means while moving said object and said paint spraying means with respect to each other, said method comprising the steps of: coating said upper surface with paint sprays ejected from said paint spraying means; thereafter stopping the ejection of the paint sprays from said paint spraying means and lowering said paint spraying means to a position near a lower end of said trailing surface; and elevating said paint spraying means along said trailing surface, while ejecting paint sprays from said paint spraying means toward said trailing surface to coat the trailing surface.

A still further object of the present invention is to provide a method of painting the upper and trailing surfaces of the three-dimensional object, wherein said paint spraying means comprises a plurality of paint spray guns, further including the step of: reciprocally moving said paint spray guns in a direction across a direction in which said object and said paint spraying means are moved with respect to each other, while coating said upper and trailing surfaces.

A yet further object of the present invention is to provide a method of painting the upper and trailing surfaces of the three-dimensional object, wherein said object is an automotive body.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
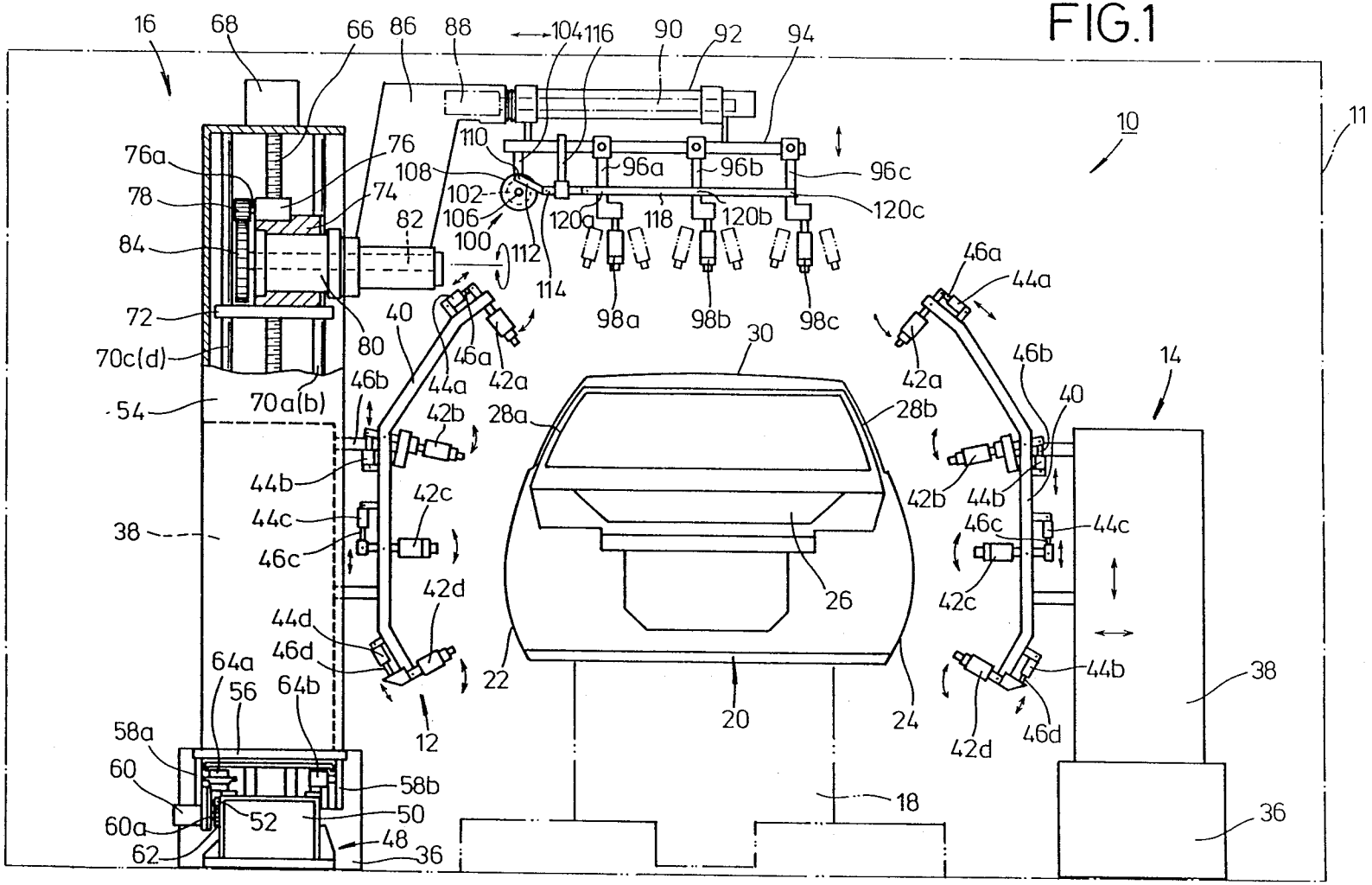
FIG. 1 is a side elevational view, partly in cross section, of a painting apparatus for carrying out a painting method according to the present invention.
Figure 2C:
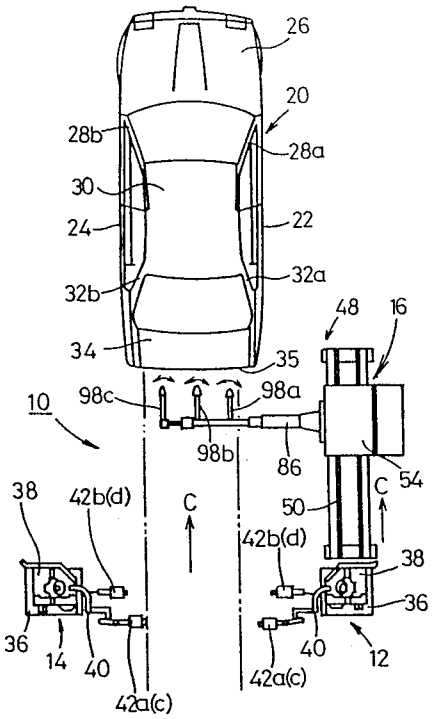
FIGS. 2(*a*) through 2(*c*) are plan views showing an operation of the painting apparatus of FIG. 1 for coating an automotive body.

FIG. 1 shows a painting apparatus, generally designated by the reference numeral 10, for carrying out a method according to the present invention. The painting apparatus 10 is disposed in a coating booth 11 in which a fluid, e.g., air, is forced to flow downwardly (see FIG. 3). The painting apparatus 10 includes a righthand side painting mechanism 12, a lefthand side painting mechanism 14, and an upper painting mechanism 16, for coating an automotive body 20 which is being conveyed by a vehicle body conveyor mechanism 18 disposed along a coating line. The automotive body 20 has various surfaces to be coated such as a righthand side panel 22, a lefthand side panel 24, an engine hood 26, front pillars 28*a*, 28*b*, a roof 30, rear pillars 32*a*, 32*b*, a trunk lid 34, and a substantially vertical rear panel 35 (see FIGS. 2(*a*) through 2(*c*) and FIG. 3).

The righthand and lefthand side painting mechanisms 12, 14 are basically identical in construction to each other. Therefore, only the lefthand side painting mechanism 14 will hereinafter be described, and the righthand side painting mechanism 12 will not be described in detail.

As shown in FIG. 1, the lefthand side painting mechanism 14 includes a base 36 disposed on a floor. An upstanding casing 38 is mounted on the base 36, and a gun arm 40 is vertically and horizontally displaceable by an actuator (not shown) disposed in the casing 38. Paint spray guns 42*a* through 42*d* are swingably mounted on the gun arm 40 at spaced intervals. Cylinders 44*a* through 44*d* are also swingably mounted on the gun arm 40 and have respective piston rods 46*a* through 46*d* which engage ends of the paint spray guns 42*a* through 42*d*, respectively.

The upper painting mechanism 16 includes a rail assembly 48 parallel to the vehicle body conveyor mechanism 18. The rail assembly 48 has a rail bracket 50 extending from one end to the other of the rail assembly 48. A rack 52 is mounted on a vertical outer side of the rail bracket 50 and extends longitudinally along the rail bracket 50. A casing 54 is movably mounted on the rail bracket 50. To the lower end of the casing 54, there is fixed a plate 56 with a pair of spaced side plates 58*a*, 58*b* secured to the lower surface thereof at opposite sides. A running motor 60 is supported on the side plate 58*a* and has a rotatable shaft 60*a* supporting a pinion 62 on its distal end which meshes with the rack 52 on the rail bracket 50. Rollers 64*a*, 64*b* are rotatably mounted respectively on the side plates 58*a*, 58*b* in rolling engagement with the rail bracket 50.

A vertically ball screw 66 is rotatably supported in the casing 54 and has an upper end coupled to the drive shaft of a lifting/lowering motor 68 mounted on the upper surface of the casing 54. Four parallel guide rods 70*a* through 70*d* are vertically disposed around the ball screw 66. A support plate 72 is threaded over the ball screw 66 for vertical movement responsive to rotation of the ball screw 66 caused by the lifting/lowering motor 68. The guide rods 70*a* through 70*d* extend through the support plate 72.

A turning motor 76 is fixedly mounted on the upper surface of the support plate 72 through a holder 72. A gear 78 is attached to the rotatable shaft 76*a* of the turning motor 76. The holder 74 holds a bearing 80 therein in which a turning shaft 82 is rotatably supported. The turning shaft 82 has one end on which there is mounted a gear 84 in mesh with the gear 78. The other end of the turning shaft 82 projects out of the casing 54, and one end of a swing arm 86 is fixed to the projecting end of the shaft 82.

A shifting cylinder 88 is disposed as a shifting means in the other end of the swing arm 86. The shifting cylinder 88 has a piston rod 90 engaging in a slide sleeve 92 on which a horizontal gun arm 94 is mounted. Gun support bars 96*a* through 96*c* which are spaced from each other at intervals have upper ends swingably held on the horizontal gun arm 94. Paint spray guns 98*a* through 98*c* are supported as paint spraying means on the other lower ends of the gun support bars 96*a* through 96*c*. The paint spray guns 98*a* through 98*c* are swingable together by a swinging means 100.

The swinging means 100 includes a rotative drive source 102 suspended from a holder 104 mounted on one end of the horizontal gun arm 94. The rotative drive source 102 has a rotatable shaft 106 with a disc 108 affixed thereto. A link 112 has one end coupled to the disc 108 through an off-center pin 110 attached to the disc 108. The other end of the link 112 is coupled to a first rod 114 fitted in and held by a support 116 which is vertically slidable across the horizontal gun arm 94. A second longer rod 118 is coupled at one end to the end of the first rod 114. The second rod 118 is held in engagement with the gun support bars 96*a* through 96*c* through respective coupling pins 120*a* through 120*c*.

Figure 4:
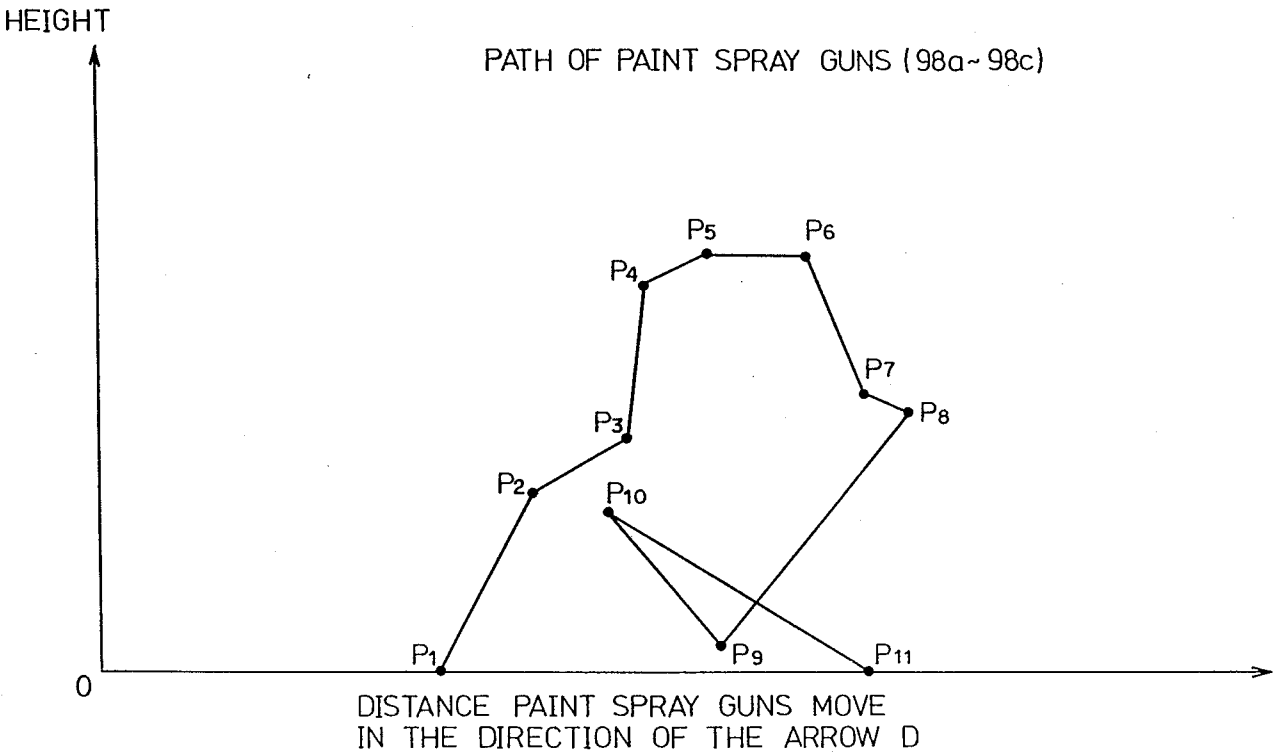
FIG. 4 is a diagram showing a path of movement of the paint spray guns.

The painting apparatus for carrying out the painting method of the invention is basically constructed as described above. Operation and advantages of the painting apparatus will now be described below also with reference to FIG. 4. FIG. 4 shows an actual path, indicated by $P_1$ through $P_{10}$, of movement of the paint spray guns 98*a* through 98*c*.

The paint spray guns 98*a* through 98*c* mounted on the upper painting mechanism 16 are positioned in a lowest location with respect to the automotive body 20 (see $P_1$ in FIG. 4). The cylinders 44*a* through 44*d* on the gun arms 40 of the side painting mechanisms 12, 14 are operated to displace the piston rods 46*a* through 46*d* in prescribed directions to swing the paint spray guns 42*a* through 42*d* into positions complementary to the shapes of the side panels 22, 24 of the automotive body 20.

Figure 2B:
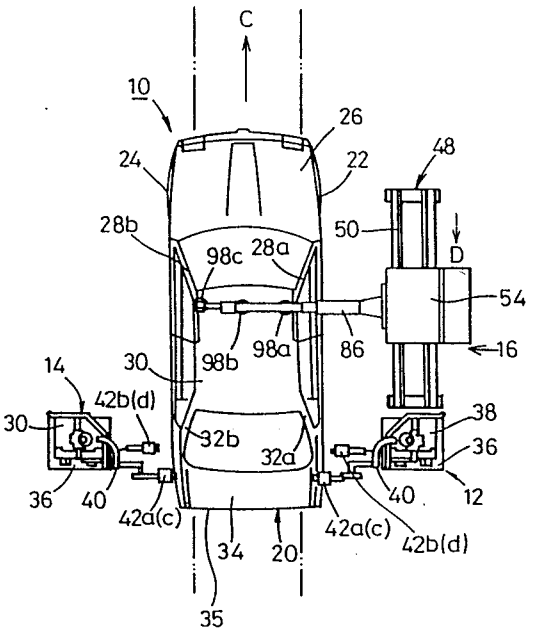
Figure 2A:
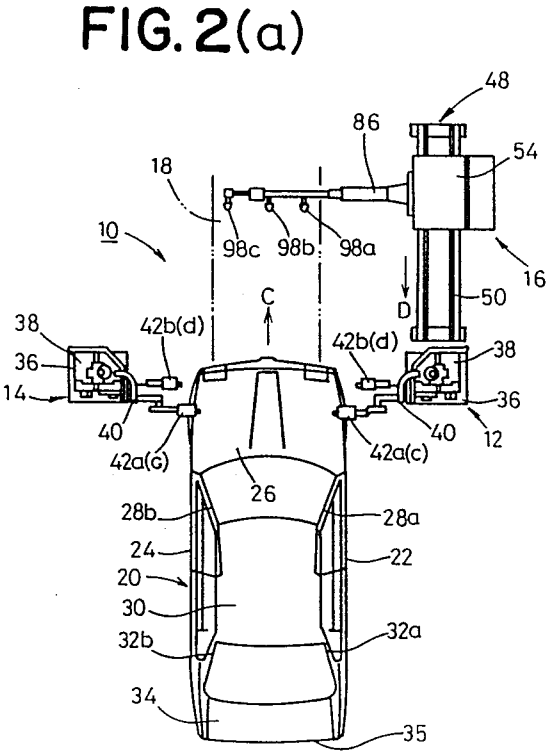

When the automotive body 20 is conveyed into the painting apparatus 10 by the vehicle body conveyor mechanism 18, paint sprays are ejected from the paint spray guns 42*a* through 42*d* of the side painting mechanisms 12, 14 toward the side panels 22, 24 of the automotive body 20, as shown in FIG. 2(*a*).

Figure 3:
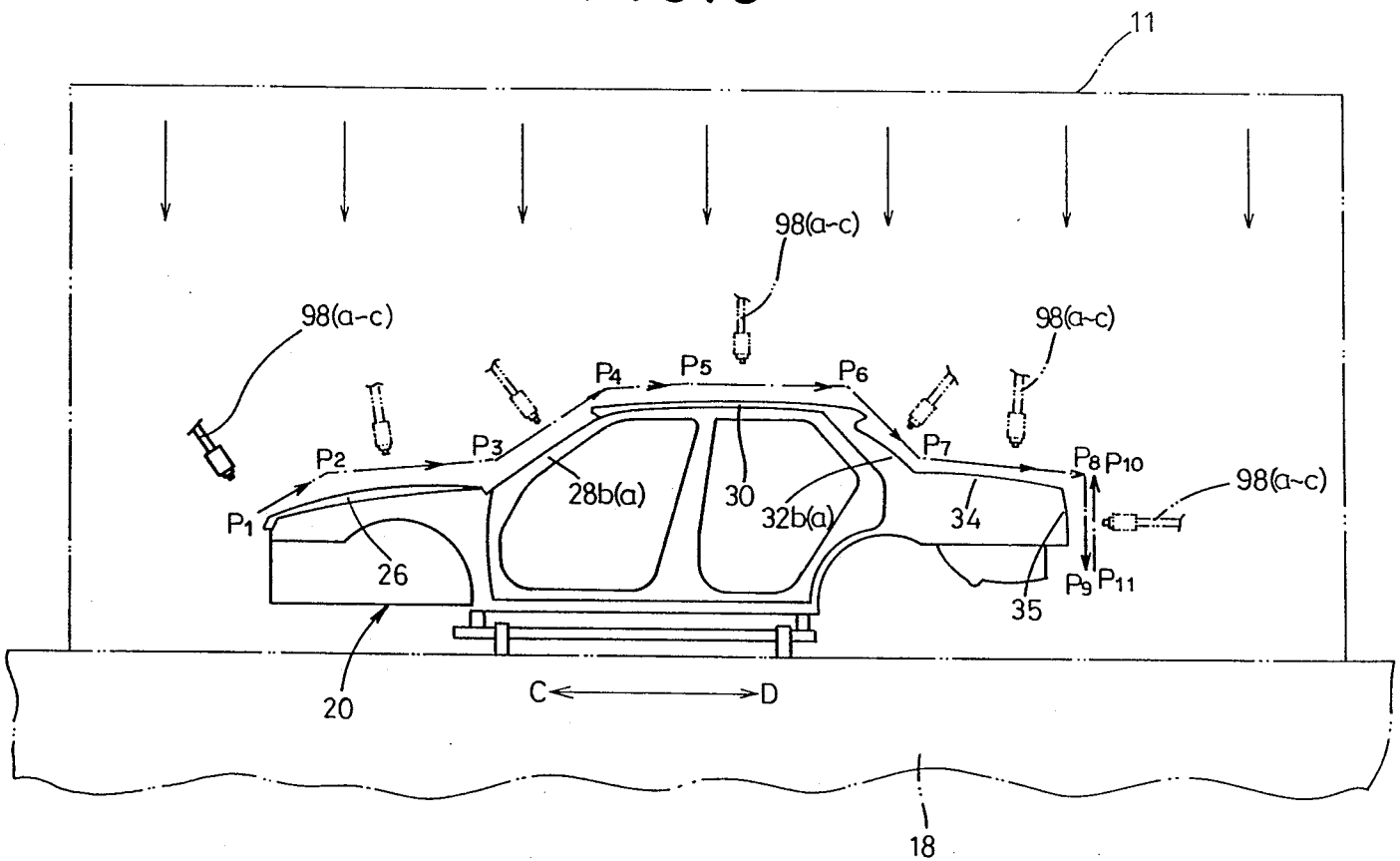
FIG. 3 is a side elevational view illustrating movement of paint spray guns while coating the automotive body.

Upon continued travel of the automotive body 20 in the direction of the arrow C, the paint spray guns 98*a* through 98*c* of the upper painting mechanism 16 confront the engine hood 26 of the automotive body 20 (as indicated by the solid lines in FIG. 3). The paint spray guns 98a through 98c now start ejecting paint sprays therefrom toward the engine hood 26, while at the same time the paint spray guns 98a through 98c are swung and moved from the position $P_1$ via a position $P_2$ to a position $P_3$. More specifically, the rotative drive source 102 is operated to rotate the shaft 106 and hence the disc 108 clockwise in the direction of the arrow. The first and second rods 114, 118 coupled to the off-center pin 110 on the disc 108 via the link 112 are therefore moved back and forth horizontally. The gun support bars 96a through 96c swingably coupled to the second rod 118 by the respective pins 120a through 120c are angularly displaced about their ends connected to the horizontal gun arm 94, thereby causing the distal lower ends of the paint spray guns 98a through 98c to swing laterally back and forth.

The lifting/lowering motor 68 is energized to rotate the ball screw 66 about its own axis, whereupon the turning arm 86 is elevated by the support plate 72 threaded over the ball screw 66 to lift.the paint spray guns 98a through 98c on the swing arm 86.

Then, the running motor 60 is energized to rotate the pinion 62 on the shaft 60a thereof. The casing 54 is now moved along the rail bracket 50 at a predetermined speed in the direction of the arrow D through the rack 52 meshing with the pinion 62. At the same time, the automotive body 20 is conveyed at a given speed in the direction of the arrow C by the vehicle body conveyor mechanism 18. During such relative movement of the upper painting mechanism 16 and the automotive body 20, the paint spray guns 98a through 98c are actuated to apply a paint coat to the engine hood 26.

The turning motor 76 is energized to turn the swing arm 86 about the shaft 82 in the direction of the arrow through the gear 84 meshing with the gear 78 supported on the shaft 76a of the motor 76. The paint spray guns 98a through 98c are directed perpendicularly to the engine hood 26 while being spaced a predetermined distance from the engine hood 26.

After the engine hood 26 has been coated, the turning motor 76 is energized to orient the paint spray guns 98a through 98c perpendicularly to the front pillars 28a, 28b. The running motor 60 and the lifting/lowering motor 68 are energized to displace the paint spray guns 98a through 98c from the position $P_3$ to a position $P_4$. Simultaneously, the automotive body 20 is conveyed at a given speed in the direction of the arrow C. The paint spray guns 98a, 98c are actuated to eject paint sprays to coat the front pillars 28a, 28b. At this time, the paint spray gun 98d is disabled.

After having coated the front pillars 28a, 28b, the turning motor 76 is energized to angularly position the paint spray guns 98a through 98c complementarily to a front slanted area of the roof 30 of the automotive body 20 so that the paint spray guns 98a through 98c are directed perpendicularly to the front slanted area of the roof 30 and spaced a predetermined distance therefrom. The running and lifting/lowering motors 60, 68 are energized to move the paint spray guns 98a through 98c up to a position $P_5$, after which the paint spray guns 98a through 98c are directed vertically downwardly. The paint spray guns 98a through 98c are further displaced to a position $P_6$ by the running motor 60, while at the same time paint sprays are ejected from the paint spray guns 98a through 98c to coat the roof 30 of the automotive body 20 which is being conveyed in the direction of the arrow C.

As illustrated in FIG. 2(b), the side panels 22, 24 of the automotive body 20 have substantially fully been coated by the side painting mechanisms 12, 14 by this time. In coating the side panels 22, 24, the gun arms 40 of the side painting mechanisms 12, 14 are displaced vertically and horizontally to move the paint spray guns 42a through 42d to positions complementary to the shapes of the side panels 22, 24 for uniformly coating the side panels 22, 24.

After completion of the coating of the roof 30, the turning motor 76 is energized to enable the swing arm 86 to direct the paint spray guns 98a through 98c perpendicularly to the rear pillars 32a, 32b with a predetermined spacing kept therefrom. The paint spray guns 98a through 98c are moved from the position $P_6$ to a position $P_7$, during which time the rear pillars 32a, 32b are coated by the paint spray guns 98a through 98c. The paint spray guns 98a through 98c are further moved from the position $P_7$ through a position $P_8$ to coat the trunk lid 34. At this time, the paint spray guns 98a through 98c are directed perpendicularly to the trunk lid 34 by energizing the turning motor 76.

After the engine hood 26, the front pillars 28a, 28b, the roof 30, the rear pillars 32, 32b, and the trunk lid 34 have been coated in the manner described above, the rear surface 35 of the automotive body 20 is coated. According to the illustrated embodiment, the rear surface 35 is coated by the following process:

When the paint spray guns 98a through 98c reach the position $P_8$ at the rear end of the trunk lid 34, the ejection of paint sprays from the paint spray guns 98a through 98c is interrupted, and the turning motor 76 is energized to turn the paint spray guns 98a through 98c into a horizontal position so that they are directed perpendicularly to the rear surface 35. Then, the lifting/-lowering motor 68 is energized to lower the paint spray guns 98a through 98c, and the running motor 60 is energized to move the casing 54 to deliver the paint spray guns 98a through 98c in the direction of the arrow C at the same speed as the speed of travel of the automotive body 20 (see FIG. 2(c)).

When the paint spray guns 98a through 98c reaches a position $P_9$ near the lower end of the rear surface 35, the lifting/lowering motor 68 is reversed to elevate the paint spray guns 98a through 98c, and at the same time the rotative drive source 102 is operated to swing the paint spray guns 98a through 98c. Paint sprays are ejected from the paint spray guns 98a through 98c to coat the rear surface 35. Since the paint spray guns 98a through 98c are moved in the direction of the arrow C at the same speed as the speed of travel of the automotive body 20, the paint spray guns 98a through 98c remain spaced a constant distance from the rear surface 35 while the paint sprays are being ejected from the paint spray guns 98a through 98c. At the time the paint spray guns 98a through 98c reach a position $P_{10}$, the rear surface 35 is fully coated. Then, the paint spray guns 98a through 98c are shut off, and moved to a position $P_{11}$.

The coating process for the automotive body 20 is now completed. The automotive body 20 is further conveyed in the direction of the arrow C into another working station. A new uncoated automotive body 20 is then delivered into the painting apparatus 10 by the vehicle body conveyor mechanism 18. At this time, the paint spray guns 98a through 98c are disposed in the position $P_1$.

According to the present embodiment, when coating the rear surface 35 of the automotive body 20, the paint spray guns 98*a* through 98*c* are first lowered to a position near the lower end of the rear surface 35, and then elevated while ejecting paint sprays toward the rear surface 35. Since the vertical rear surface 35 is coated progressively upwardly, a mist of excessive paint ejected from the paint spray guns 98*a* through 98*c* and floating in the coating booth 11 is not applied to the paint spray guns 98*a* through 98*c*.

More specifically, in the conventional coating process, inasmuch as the paint spray guns 98*a* through 98*c* are displaced downwardly while coating the vertical rear surface 35, a mist of excessive paint which is forced to drop by air flowing downwardly in the coating booth 11 tends to be applied to the paint spray guns 98*a* through 98*c*. According to the painting method of the present invention, however, the paint spray guns 98*a* through 98*c* are moved upwardly and hence a mist of excessive paint which is ejected from the paint spray guns 98*a* through 98*c* and forced to fall by a downward air flow is prevented from being deposited on the paint spray guns 98*a* through 98*c*. It is therefore not necessary to clean the paint spray guns 98*a* through 98*c* frequently, and the coating process can be performed highly efficiently. Because the paint spray guns 98*a* through 98*c* do not need to be cleaned often, their maintenance is facilitated.

With the present invention, as described above, when coating a vertical surface of an object, e.g., a vertical rear surface of an automotive body, paint spraying means is lowered to a position near the lower end of the rear surface, and then elevated while applying paint sprays to the rear surface. Since the paint spraying means is displaced upwardly while applying a paint coat to the vertical rear surface, a mist of excessive paint which falls without being applied to the rear surface is not deposited on the paint spraying means. Therefore, no unwanted paint is applied to the paint spraying means, and the paint spraying means is not required to be cleaned frequently. As a consequence, the coating process is made highly efficient.

Although a certain preferred embodiment has been shown and described, it should be understood that many changes and modifications may be made therein without departing from the scope of the appended claims.

What is claimed is:

1. A method of painting a substantially vertical surface of an object in a coating booth in which a fluid is supplied a downward direction to forcibly lower a mist of floating paint particles, said method comprising the steps of:

positioning paint spraying means for ejecting paint sprays, perpendicularly to said vertical surface; and displacing said paint spraying means with respect to said vertical surface in a direction against said downward direction in which said fluid is supplied, while ejecting paint sprays from said paint spraying means to coat said vertical surface.

2. A method according to claim 1, wherein said paint spraying means comprises a plurality of paint spray guns, further including the step of:

reciprocally moving said paint spray guns in a direction across said direction in which said paint spraying means is displaced, while displacing said paint spraying means with respect to said vertical surface.

3. A method according to claim 1 or 2, wherein said object is an automotive body.

4. A method of painting an upper surface and a trailing surface of a three-dimensional object with paint spraying means while moving said object and said paint spraying means with respect to each other, said method comprising the steps of:

coating said upper surface with paint sprays ejected from said paint spraying means;

thereafter stopping the ejection of the paint sprays from said paint spraying means and lowering said paint spraying means to a position near a lower end of said trailing surface; and elevating said paint spraying means along said trailing surface, while ejecting paint sprays from said paint spraying means toward said trailing surface to coat the trailing surface.

5. A method according to claim 4, wherein said paint spraying means comprises a plurality of paint spray guns, further including the step of:

reciprocally moving said paint spray guns in a direction across a direction in which said object and said paint spraying means are moved with respect to each other, while coating said upper and trailing surfaces.

6. A method according to claim 4 or 5, wherein said object is an automotive body.

* * * * *